US008851230B2

(12) United States Patent
Ono et al.

(10) Patent No.: US 8,851,230 B2
(45) Date of Patent: Oct. 7, 2014

(54) EXHAUST SYSTEM FOR A MOTORCYCLE

(71) Applicant: Kawasaki Jukogyo Kabushiki Kaisha, Hyogo (JP)

(72) Inventors: Masashi Ono, Hyogo (JP); Toshiyuki Tsubone, Kobe (JP); Yota Katsukawa, Himeji (JP); Satoshi Matsumoto, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 13/969,343

(22) Filed: Aug. 16, 2013

(65) Prior Publication Data

US 2014/0060963 A1 Mar. 6, 2014

(30) Foreign Application Priority Data

Sep. 4, 2012 (JP) ..... 2012-193796

(51) Int. Cl.

| | |
|---|---|
| ***F01N 13/08*** | (2010.01) |
| ***F01N 1/02*** | (2006.01) |
| ***B60K 13/04*** | (2006.01) |
| ***F01N 1/08*** | (2006.01) |
| ***F01N 1/00*** | (2006.01) |
| *F01N 13/00* | (2010.01) |
| *B62D 61/02* | (2006.01) |
| *B60K 13/00* | (2006.01) |

(52) U.S. Cl.

CPC *F01N 1/00* (2013.01); *F01N 1/089* (2013.01); *F01N 2340/04* (2013.01); *F01N 2590/04* (2013.01); *F01N 2470/14* (2013.01); *F01N 2490/04* (2013.01)

USPC ..... 181/228; 181/227; 181/249; 180/309; 180/296; 180/219

(58) Field of Classification Search

USPC ..... 181/228, 227, 251, 249, 255, 269, 272, 181/282, 281; 180/309, 296, 219, 218, 251, 180/68.3, 89.2, 291

See application file for complete search history.

(56) References Cited

U.S. PATENT DOCUMENTS

| | | | | | |
|---|---|---|---|---|---|
| 3,949,829 | A | * | 4/1976 | Honda et al. | 181/227 |
| 4,359,865 | A | * | 11/1982 | Nakao et al. | 60/313 |
| 4,800,719 | A | * | 1/1989 | Campbell | 60/313 |
| 4,809,800 | A | * | 3/1989 | Suzuki | 180/219 |
| 4,860,538 | A | * | 8/1989 | Takeuchi | 60/313 |
| 5,227,593 | A | * | 7/1993 | Takahashi et al. | 181/255 |

(Continued)

FOREIGN PATENT DOCUMENTS

| | | | | | |
|---|---|---|---|---|---|
| JP | 59005824 | A | * | 1/1984 | F01N 7/04 |
| JP | 03082690 | A | * | 4/1991 | B62K 11/02 |
| JP | 03135894 | A | * | 6/1991 | B62M 7/02 |
| JP | 05-262272 | | | 10/1993 | |

*Primary Examiner* — Edgardo San Martin

(57) ABSTRACT

A motorcycle includes an exhaust chamber (82), having defined therein a chamber expansion compartment (90) for exhaust gases, and a muffler (84) having defined therein muffler expansion compartments (92, 94, 96) for the exhaust gases on a downstream side of the exhaust chamber (82). Respective outer peripheral walls of the exhaust chamber (82) and the muffler (84) are formed by a common casing (69). The exhaust chamber (82) is positioned intermediate between a motorcycle combustion engine (E) and a motorcycle rear wheel (22). The exhaust chamber (82) has an inner side surface positioned laterally inwardly of an outer side surface (22*a*) of the rear wheel (22) in a motorcycle body widthwise direction, and the muffler (84) has a rear portion positioned laterally outwardly of the rear wheel (22).

16 Claims, 7 Drawing Sheets

(56) References Cited

U.S. PATENT DOCUMENTS

| | | | | |
|---|---|---|---|---|
| 6,941,751 | B2 * | 9/2005 | Yamamoto et al. | 60/322 |
| 7,540,347 | B2 * | 6/2009 | Taniguchi et al. | 180/219 |
| 7,699,134 | B2 * | 4/2010 | Terashima et al. | 180/309 |
| 7,735,602 | B2 * | 6/2010 | Yasuda et al. | 181/227 |
| 7,828,114 | B2 * | 11/2010 | Morita et al. | 181/228 |
| 7,882,700 | B2 * | 2/2011 | Yamakura et al. | 60/323 |
| 7,895,832 | B2 * | 3/2011 | Gruber | 60/299 |
| 8,033,357 | B2 * | 10/2011 | Nishijima | 180/296 |
| 8,109,084 | B2 * | 2/2012 | Morita et al. | 60/324 |
| 8,127,887 | B2 * | 3/2012 | Terashima et al. | 181/251 |
| 8,602,158 | B2 * | 12/2013 | Hayama et al. | 181/228 |
| 2009/0166115 | A1 * | 7/2009 | Mizutani et al. | 180/68.3 |
| 2011/0225953 | A1 * | 9/2011 | Ono et al. | 60/276 |
| 2012/0205191 | A1 * | 8/2012 | Matsushima et al. | 181/227 |
| 2013/0199869 | A1 * | 8/2013 | Murakami et al. | 181/228 |

* cited by examiner

EXHAUST SYSTEM FOR A MOTORCYCLE

CROSS REFERENCE TO THE RELATED APPLICATION

This application is based on and claims Convention priority to Japanese patent application No. 2012-193796, filed Sep. 4, 2012, the entire disclosure of which is herein incorporated by reference as a part of this application.

BACKGROUND OF THE INVENTION

1. Field of the Invention

The present invention relates to an exhaust system for a motorcycle, which includes an exhaust chamber and a muffler for silencing noises generated by exhaust gases then flowing therethrough from a combustion engine towards the atmosphere.

2. Description of Related Art

A certain motorcycle having a combustion engine employed as a drive source therefor has been known, in which an exhaust chamber of a large capacity is provided at a location upstream of a muffler and beneath the combustion engine. This type of motorcycle is disclosed in, for example, the JP Laid-open Patent Publication No. H05-262272. The use of the exhaust chamber in the way as discussed in the above mentioned patent document is effective to allow the use of a downsized muffler at a location downstream of the exhaust chamber, resulting in an improvement in and of the appearance of the motorcycle.

It has however been found that where no space is available for the installation of a large sized exhaust chamber, it has been difficult to downsize the muffler. It has also been found that if a space for installation of the exhaust chamber is sought at a location below the combustion engine, the necessity will arise that the combustion engine must be positioned above the exhaust chamber a distance corresponding to the size of such exhaust chamber in order to secure the minimum ground clearance, accompanied by elevation of the center of gravity of the motorcycle as a whole.

SUMMARY OF THE INVENTION

The present invention has been devised in view of the foregoing problems and inconveniences and is intended to provide a motorcycle of a kind in which while a sufficient silencing effect is maintained, the length of the muffler as measured in a direction substantially or generally parallel to the longitudinal sense of the motorcycle is reduced to thereby improve the appearance of the motorcycle.

In order to accomplish the foregoing object, the present invention provides a motorcycle of a type using a combustion engine as a drive source, which motorcycle includes an exhaust chamber having defined therein a chamber expansion compartment for exhaust gases and also having a first outer peripheral wall; and a muffler having defined therein a muffler expansion compartment for the exhaust gases and also having a second outer peripheral wall, the muffler being positioned downstream of the exhaust chamber with respect to the direction of flow of the exhaust gases. In such case, the exhaust chamber is positioned between the combustion engine and a rear wheel; the first and second outer peripheral walls of the exhaust chamber and the muffler are formed by a common casing; a partition wall divides the casing in an anteroposterior direction to define the chamber expansion compartment, which is positioned forwardly of the partition wall, and the muffler expansion compartment which is positioned rearwardly of the partition wall, a rear end shape of the chamber expansion compartment and a front end shape of the muffler expansion compartment being identical with each other; the exhaust chamber has an inner side surface that is positioned inwardly of an outer side surface of the rear wheel in a motorcycle body widthwise direction; and the muffler has a rear portion that is positioned on an outer side of the rear wheel. It is to be noted that the term "common casing" referred to above and hereinafter is to be construed as a single casing including the respective outer peripheral walls of the exhaust chamber and the muffler. It is also to be noted that the term "chamber expansion compartment" referred to above is to be construed as including a resonance compartment.

According to the features, since the exhaust chamber is positioned intermediate between the combustion engine and the rear wheel and the inner side surface of the exhaust chamber is positioned inwardly of the outer side surface of the rear wheel in the motorcycle body widthwise direction, without the space below the combustion engine being compressed, the exhaust chamber of an increased capacity can be disposed. As a result, a sufficient silencing effect can be maintained, and also the muffler can be downsized to enhance the appearance of the motorcycle. Also, since the outer peripheral wall of the exhaust chamber and the outer peripheral wall of the muffler are formed by the common casing and the rear end shape of the chamber expansion compartment and the front end shape of the muffler expansion compartment are made identical with each other, the expansion space, which is defined foremost within the muffler communicated with the exhaust chamber of the increased capacity, can be increased. As a result, a further downsizing of the muffler and a further increase of the silencing effect can be accomplished.

As discussed above, since the muffler can be downsized, the length of the muffler in the anteroposterior direction can be shortened and the position of the exhaust device including the muffler can therefore be brought to a location close to the center of gravity of the motorcycle body. As a result, the straightforward travel characteristic and the steerability of the motorcycle increase. Yet, since the exhaust chamber and the muffler do not compress the space below the combustion engine, the position of the combustion engine can be lowered to lower the center of gravity of the motorcycle. The partition wall referred to above is preferably disposed in a portion of the casing where a change in longitudinal sectional area is moderate.

In a preferred embodiment of the present invention, a motorcycle body inner side end of a front wall of the muffler is positioned inwardly of the outer side surface of the rear wheel in the motorcycle body widthwise direction and a motorcycle outer side end of the front wall of the muffler is positioned outwardly of the outer side surface of the rear wheel in the motorcycle body widthwise direction. According to this construction, the motorcycle body widthwise dimension of the front portion of the muffler becomes large and, therefore, the expansion space positioned foremost within the muffler can be increased further.

In another preferred embodiment of the present invention, the motorcycle may include a pipe extending through the chamber expansion compartment to form a part of an exhaust passage, and the pipe may have a peripheral wall provided with communicating holes to communicate with the chamber expansion component. The use of the perforated pipe makes it possible to obtain an enhanced silencing effect by increasing an effect of silencing a particular frequency band with the utilization of the resonance effect.

In a further preferred embodiment of the present invention, the muffler is disposed on one side of the rear wheel with respect to a motorcycle body widthwise direction, in which case a rear wheel shock absorbing mechanism is positioned on the opposite side of the motorcycle body widthwise direction with respect to a longitudinal mid-center line and also is juxtaposed to the exhaust chamber in the motorcycle body widthwise direction. According to this construction, it is easy to dispose the exhaust chamber at a location inwardly of the motorcycle body.

In a still further preferred embodiment of the present invention, the motorcycle preferably include an exhaust device to regulate an exhaust passage sectional area, in which case the exhaust device is disposed upstream of the exhaust chamber. According to this construction, a reaction of the exhaust characteristic change relative to the valve operation will be good as compared with the disposition of the exhaust device at a position immediately preceding the muffler.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, a preferred embodiment of the present invention will be described in detail with particular reference to the accompanying drawings. It is to be noted that the terms "left" and "right" are used to denote opposite positions or directions, respectively, relative to a motorcycle rider or motorist then occupying a motorcycle rider's seat and looking forwards in a direction parallel to the longitudinal sense of the motorcycle.

Figure 1:
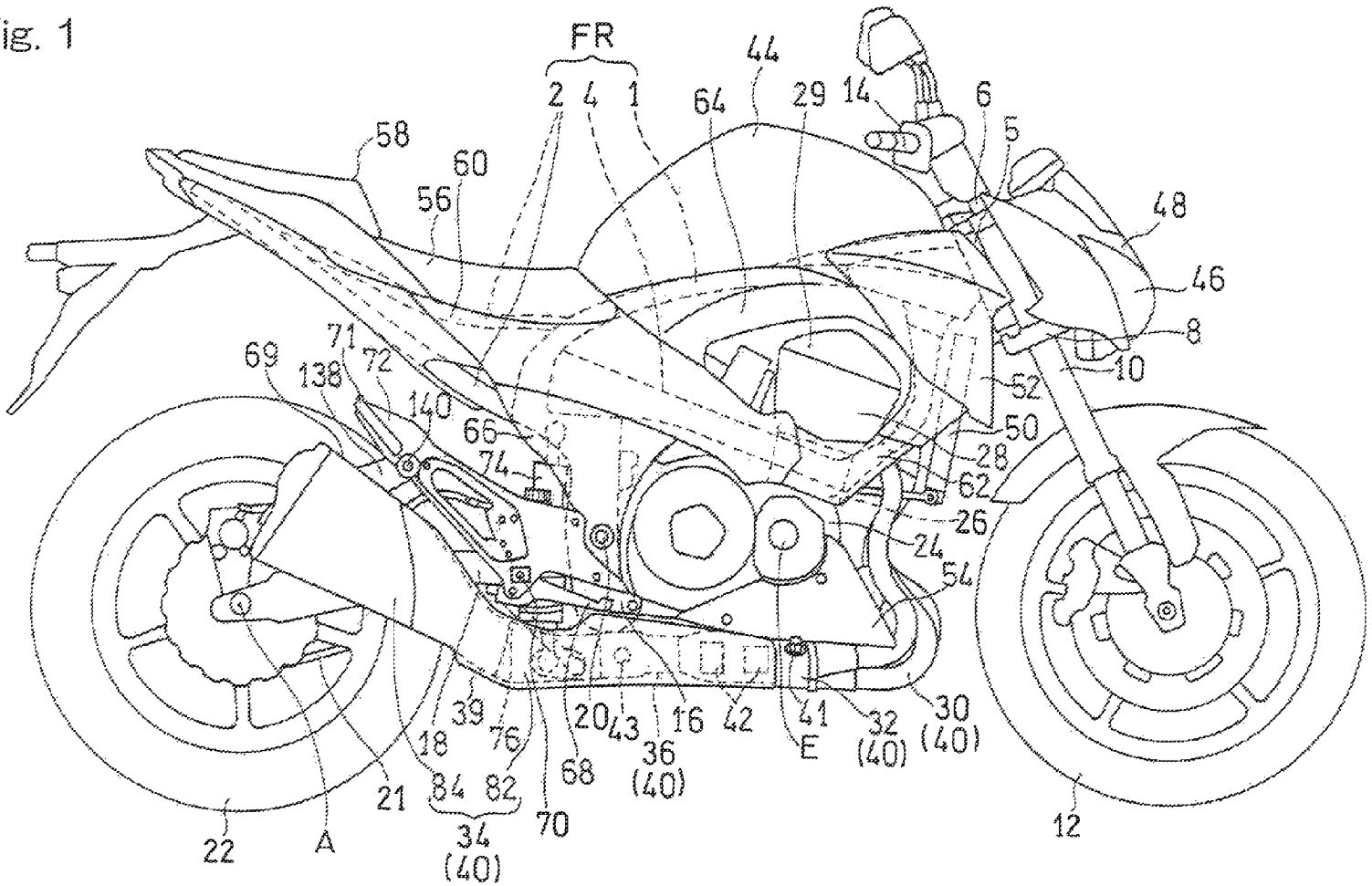
FIG. 1 is a side view showing a motorcycle designed in accordance with a preferred embodiment of the present invention.

Referring first to FIG. 1 showing a side view of a motorcycle embodying the present invention, a motorcycle frame structure FR of the motorcycle includes a main frame 1 which forms a part of a front frame assembly, a rear frame 2 which is rigidly connected with a rear portion of the main frame 1 and forms a part of a rear frame assembly, and a pair of left and right subframes 4 positioned laterally outwardly of a motorcycle combustion engine E so as extend from a front portion of the main frame 1 to a rear portion thereof.

The main frame 1 has a front end portion provided with a head tube 5, and an upper bracket 6 and a lower bracket 8 are supported by this main frame 1 through a steering shaft (not shown) which is rotatably inserted into the head tube 5. A front fork assembly 10 is supported by the upper and lower brackets 6 and 8 with a front wheel 12 rotatably supported at a lower end portion of the front fork assembly 10. The upper bracket 6 at an upper end portion of the front fork assembly 10 has a steering handlebar 14 mounted thereon for angular movement together with the front fork assembly 10.

A rear end portion of the main frame 1 is inclined rearwardly slantwise, and a swingarm bracket 16 is formed at this rear end portion of the main frame 1. A swingarm 18 is pivotally supported by the swingarm bracket 16 through a pivot shaft 20, with a rear wheel 22 rotatably supported by a rear end portion of the swingarm 18. A motorcycle combustion engine E, which is a drive source for the motorcycle, is mounted on an intermediate portion of the main frame 1 with respect to the longitudinal sense of the motorcycle, in a fashion tilted forwardly. The rear wheel 22 referred to above is driven by the combustion engine E through a transmission member 21 such as, for example, a substantially endless chain.

The motorcycle combustion engine E referred to above is an internal combustion engine and, in describing the preferred embodiment, is a parallel multi-cylinder, water cooled internal combustion engine such as, for example, a four-cylinder, four-stroke water-cooled internal combustion engine. The combustion engine E includes a crankcase 24, a cylinder block 26 protruding upwardly from the crankcase 24, a cylinder head 28 mounted atop the cylinder block 26, and a head cover 29 enclosing the cylinder head 28.

Four exhaust header tubes 30 are connected with a front surface of the cylinder head 28 in communication with respective engine cylinders, which are defined in the cylinder block 24 in cooperation with the cylinder head 28, and those exhaust tubes 30 have their downstream ends merged together at a collecting tube 32. This collecting tube 32 has a downstream end with respect to the direction of flow of exhaust gases towards the atmosphere and this downstream end of the collecting tube 32 is fluid connected through a connecting tube 36 with an exhaust silencing device 34 that is positioned rightwardly of the rear wheel 22. The exhaust silencing device 34 is of a type having a small length, i.e., short in length, having a rear end thereof positioned forwardly of an axle A of the rear wheel 22.

The exhaust tubes 30, the collecting tube 32, the exhaust silencing device 34 and the connecting tube 36 cooperate with each other to define a motorcycle exhaust system 40. Of the components defining the motorcycle exhaust system 40, the connecting tube 36 and the collecting tube 32, both positioned on an upstream side of the exhaust silencing device 34, have a vertical dimension that is smaller than the exhaust silencing device 34.

The exhaust silencing device 34 includes a single casing 69, in which an exhaust chamber 82 for temporarily reserving exhaust gases and subsequently discharging those exhaust gases and a muffler 84 for accomplishing a noise reduction by cyclically repeating expansion and contraction of the exhaust gases discharged from the exhaust chamber 82 are accommodated. A region of the exhaust system 40 ranging from a rear half of the collecting tube 32 to a front half of the muffler 84 is enclosed from outside by a covering 39 made of a steel material. The details of each of the exhaust silencing device 34 and the exhaust system 40 will be discussed later.

A fuel tank 44 is mounted atop the main frame A headlamp unit 46 is supported at a front surface portion of the front fork assembly 10, and a front cowl or fairing 48 made of a resinous material is supported by the headlamp unit 46 so as to enclose an area forwardly of and above the front fork assembly 10.

A radiator 50 for dissipating an engine coolant medium is disposed forwardly above the combustion engine E. A pair of left and right cowls 52 are mounted on the main frame 1 so as to extend from laterally upwardly of the radiator 50 to respective upper end portions of the left and right subframe 4 and laterally outwardly of the front portion of the main frame 1. A lower cowl 54 is supported beneath the combustion engine E so as to enclose a lower portion of the combustion engine E from laterally outwardly.

A seat assembly comprised of a rider's seat 56 and a fellow passenger's seat 58 is mounted on an upper portion of the rear frame 2. Rear half portions of the left and right subframes 4 are covered from outside with respective side coverings 60 each extending from a location below the rider's seat 56 to a rear portion of the cylinder block 26 of the combustion engine E. Subframe coverings 62, one on each side of the motorcycle, are supported by the subframe 4 so as to extend from respective front end portion of the associated side coverings 60 to corresponding lower portion of the side cowls 52 to thereby cover the front half portion of the subframe 4 from outside.

An upper frame covering; 64 and a lower frame covering 66 are disposed at upper and lower locations, respectively, with each side covering 60 sandwiched therebetween. The upper frame covering 64 extends from the adjacent side cowl 52 to the associated side covering 60 along a lower edge of the fuel tank 44 to thereby cover the main frame 1 from outside. On the other hand, the lower frame covering 66 extends downwardly from the associated side covering 60 to cover the swingarm bracket 16 from outside.

A bracket 72 for supporting a brake pedal 68, a rider's footrest 70 and a fellow passenger's footrest 71 is fixed to a rear portion of the swingarm bracket 16. This bracket 72 extends rearwardly slantwise from the swingarm bracket 16 along the exhaust silencing device 34.

Figure 2:
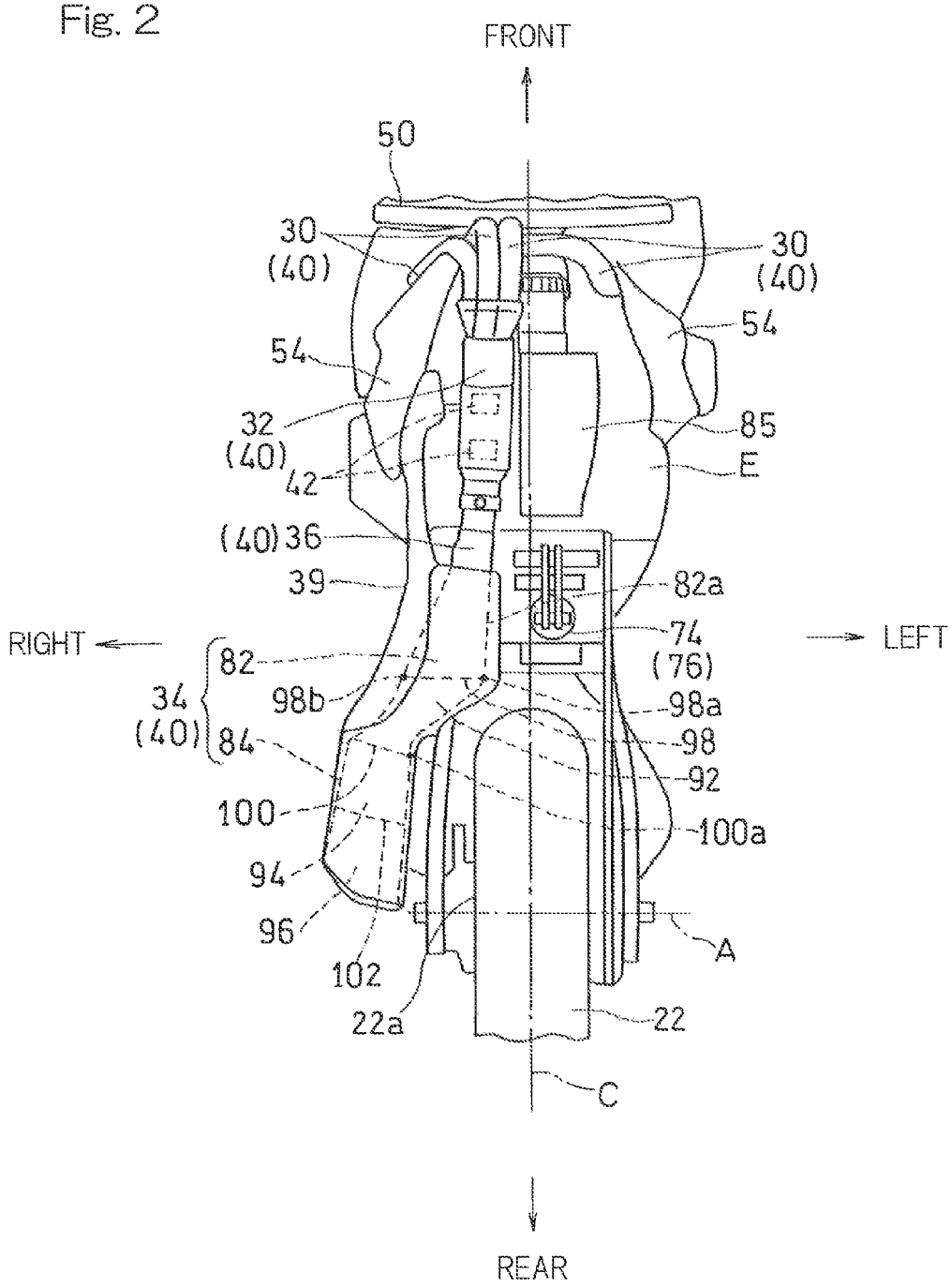
FIG. 2 is a fragmentary bottom plan view showing the motorcycle shown in FIG. 1.

A rear suspension unit 74 for connecting the rear wheel 22 and the motorcycle body is disposed at a location rearwardly of the swingarm bracket 16. This rear suspension unit 74 is in the form of a single, generally or substantially vertically extending suspension and has a lower end portion fitted to the swingarm 18 through a link mechanism 76 and an upper end portion connected with the main frame 1. A connecting portion where the rear suspension unit 74 and the link mechanism 76 are connected with each other, when viewed from side, overlaps the exhaust chamber 82. The rear suspension unit 74 and the link mechanism 76, both referred to above, cooperate with each other to define a rear wheel shock absorbing mechanism. As best shown in FIG. 2, the rear suspension unit 74 is disposed on one side of a longitudinal mid-center plane C of the motorcycle body, which extends in an anteroposterior direction parallel to the longitudinal sense of the motorcycle, remote from the exhaust chamber 82 that is disposed on a right side, that is, on a left side with respect to the longitudinal mid-center plane C of the motorcycle body so as to be generally juxtaposed with the exhaust chamber 82 in a direction substantially widthwise of the motorcycle.

Figure 3:
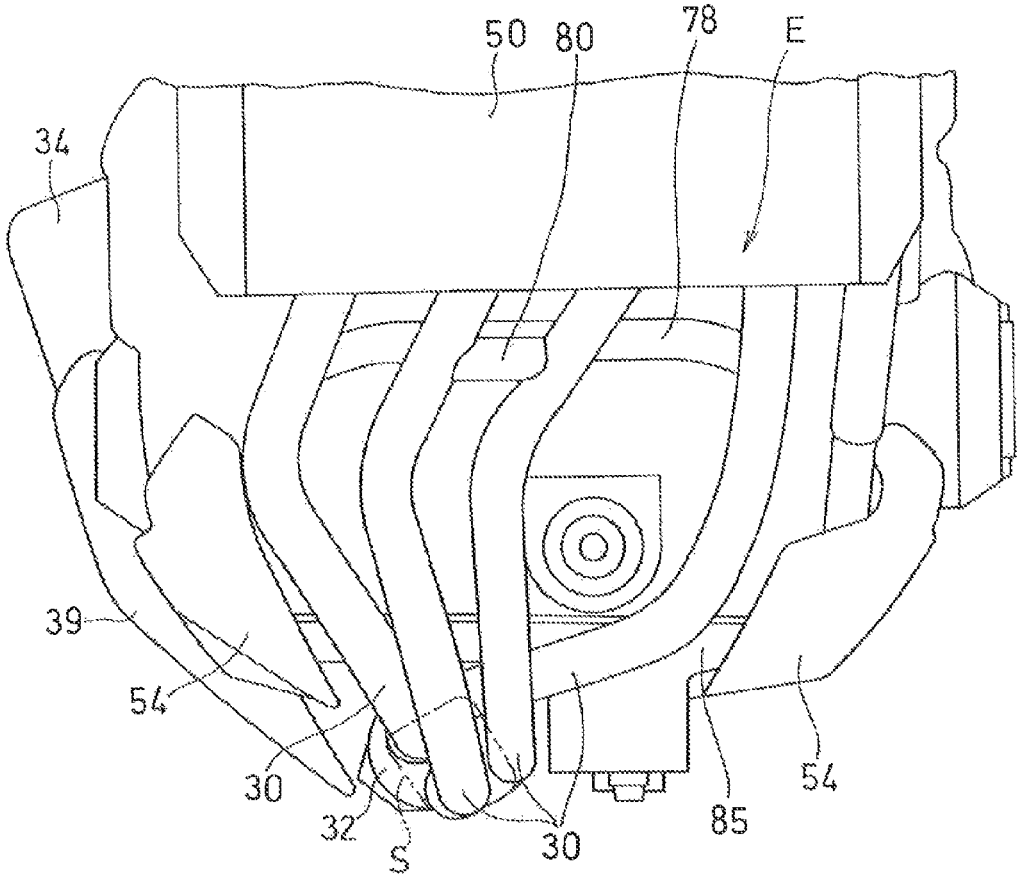
FIG. 3 is a front elevational view showing, on an enlarged scale, a combustion engine and an exhaust system both employed in the motorcycle of FIG. 1.

As shown in FIG. 1, the exhaust tubes 30 are of a shape extending in a rearward direction of the motorcycle after having been generally acutely bent and are merged together at a location beneath a front portion of the combustion engine E. As best shown in FIG. 3, of the four exhaust tubes 30 that generally parallel to each other in a widthwise direction of the motorcycle, the two, leftmost and rightmost exhaust tubes 30 and 30 are communicated with each other through a first exhaust tube communicating passage 78 and the remaining two exhaust tubes 30 and 30 intermediate between the leftmost and rightmost exhaust tubes 30 and 30 are communicated with each other through a second exhaust tube communicating passage 80. Respective downstream end portions of those four exhaust tubes 30 with respect to the direction of flow of the exhaust gases from the combustion engine towards the atmosphere are connected with a collecting tube 32 after having been bundled together so as to represent a generally square shape S with four rounded corners that is inclined relative to the vertical direction and also to the widthwise direction. Thus, bank angle is secured.

The connecting tube 36 and the collecting tube 32, each having a smaller vertical dimension than the exhaust silencing device 34 of the exhaust system 40 best shown in FIG. 2 extends substantially straightforward beneath the combustion engine E in the anteroposterior direction parallel to the longitudinal sense of the motorcycle. With the flow path so defined as to be straight, the flow path resistance is reduced to increase the engine output as compared with that exhibited by a bent flow path.

Figure 4:
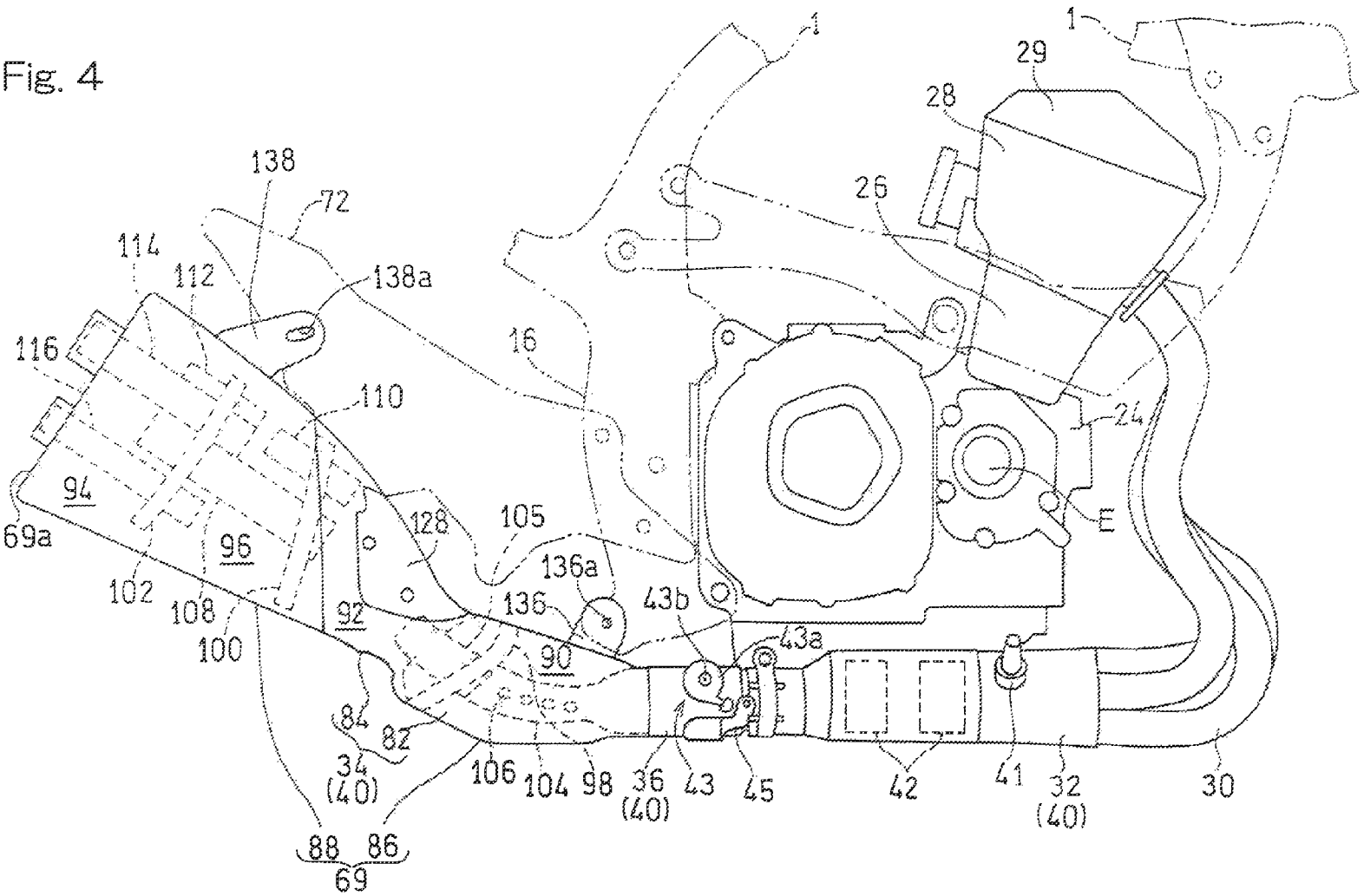
FIG. 4 is a fragmentary side view showing the combustion engine and the exhaust system both shown in FIG. 3.

Referring to FIG. 4, an oxygen sensor 41 is fitted to an upstream portion of the collecting tube 32 for detecting the concentration of oxygen contained in the exhaust gases. Also, a catalyst unit 42 is accommodated within the collecting tube 32 at a location downstream of the oxygen sensor 41 for removing obnoxious substances of the exhaust gases. The catalyst unit 42 is employed in two in number and those catalyst units 42 are positioned below the combustion engine E while having been spaced a distance from each other in the anteroposterior direction, that is, in a direction parallel to the direction of flow of the exhaust gases. It will readily be seen that with the catalyst unit 42 positioned on the upstream side of the exhaust passage where the temperature of the exhaust gases is relatively high, the rate of reaction of the catalyst can be improved. Also, since the connecting tube 36 and the collecting tube 32 extend straight as hereinabove described, the exhaust gases, which has been rectified as they flow through the catalyst unit 42, can be guided towards the exhaust chamber 82 without being considerably altered in direction of flow thereof. As a result, the sound silencing effect afforded in and by the exhaust chambers 82 can be enhanced.

The connecting tube 36 referred to above has an exhaust device 43 disposed therein for adjusting the cross sectional area of the exhaust passage, which is leading to the exhaust silencing device 34, by means of a valve opening. The provision of the exhaust device 43 referred to above is effective to optimize the engine performance characteristic by driving the exhaust device 43 in dependence on an engine operating condition. Also, the positioning of the exhaust device 43 at a location on an upstream side of the exhaust silencing device 34 makes it possible to allow the use of only one exhaust device 43 even where the exhaust silencing device is disposed on opposite lateral sides of the motorcycle body.

This exhaust device 43 has an operating member 43*a* disposed laterally outwardly of the motorcycle body and also has a valve shaft 43*b* inclined upwardly so as to extend towards the outside of the motorcycle body in the widthwise direction of the motorcycle. Accordingly, it is possible to suppress the dimension of projection of the operating member 43*a* in a direction laterally outwardly of the motorcycle to thereby gain the bank angle. The operating member 43*a* referred to above is a source for rotating the valve shaft 43*b* and is in the form of, for example, a motor.

A first covering fitting bracket 45 necessitated for the covering 39 (best shown in FIG. 1) to be fitted to the connecting tube 36 is fixedly welded to the connecting tube 36. Since the exhaust device 43 is also covered from the outside by the covering 39 that is used to cover the exhaust silencing device 34 as shown in FIG. 1, the use of any dedicated covering for that purpose can be dispensed with and the number of component parts used can therefore be reduced.

The exhaust silencing device 34 best shown in FIG. 4 includes the exhaust chamber 82 on the upstream side and the muffler 84 on the downstream side both with respect to the direction of flow of the exhaust gas towards the atmosphere, with an outer peripheral wall of the exhaust chamber 82 and an outer peripheral wall of the muffler 84 formed commonly by the single casing 69. The casing 69 referred to above includes a first casing region 86, which includes an entire outer peripheral wall of the exhaust chamber 82 and a front portion (an upstream portion) of the outer peripheral wall of the muffler 84, and a second casing region 88 including a rear portion (a downstream portion) of the outer peripheral wall of the muffler 84.

Figure 5:
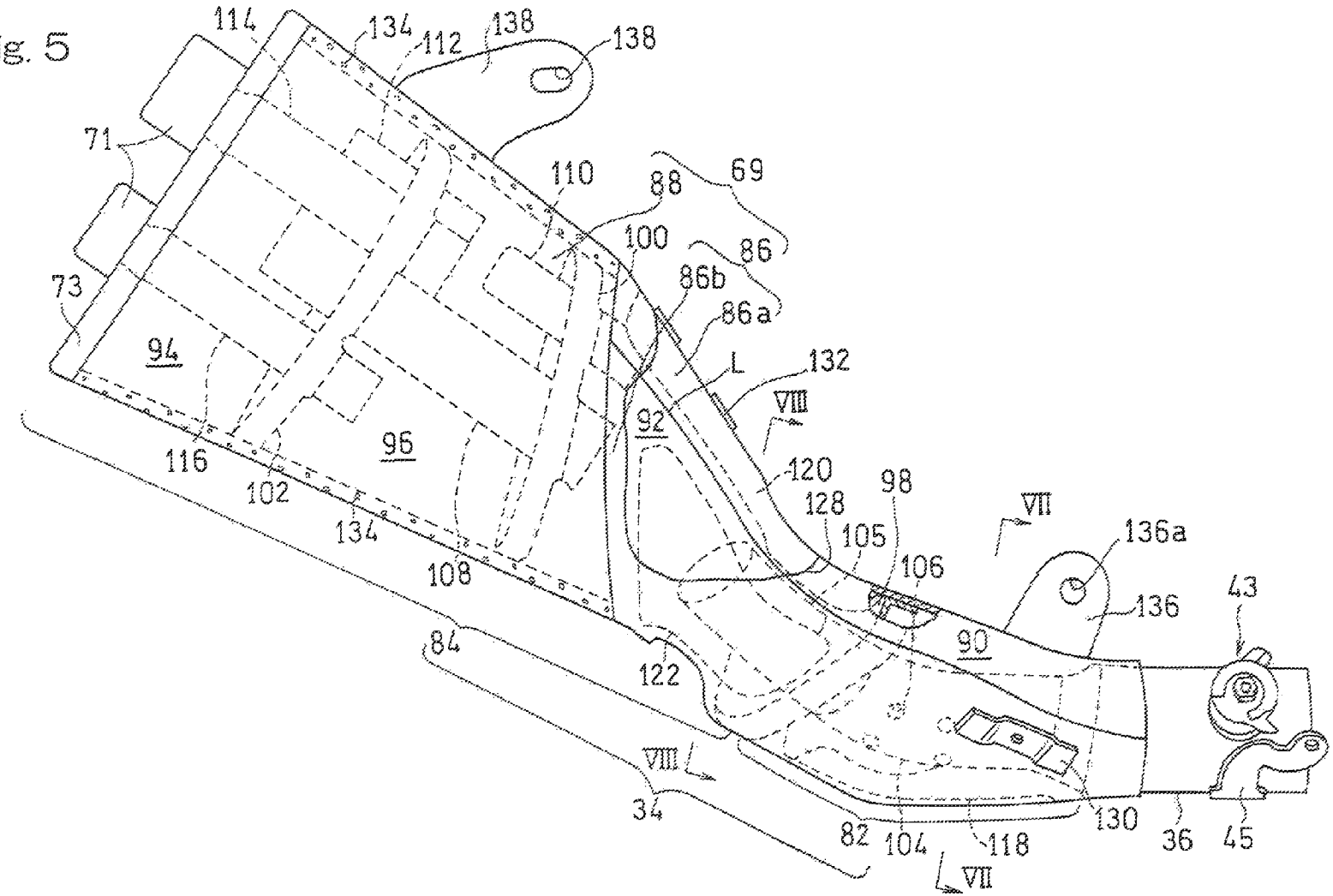
FIG. 5 is a fragmentary side view showing, on a further enlarged scale, an exhaust silencing device employed in the exhaust system.

The first casing region 86 is divided circumferentially into first casing halves 86*a* and 86*h* as shown by the line L of division in FIG. 5, whereas the second casing region 88 is made up of a single component. After the first casing halves 86*a* and 86*b* have been connected together by means of, for example, welding to thereby form the first casing region 86, the first casing region 86 and the second casing region 88 are integrated together by means of welding. A rear end of the casing 69 is closed by a rear end wall 73 having exhaust ports 71 and 71.

The exhaust chamber 82 is partitioned from the muffler 84 by a partition wall 98. In other words, with the casing 69 divided by the partition wall 98, a chamber expansion compartment 90 as will be described in detail later is defined forwardly of the partition wall 98 and a first muffler expansion compartment 92 as will be described in detail later is defined rearwardly of the partition wall 98. Hence, the partition wall 98 referred to above forms a rear wall of the exhaust chamber 82 and, at the same time, a front wall of the muffler 84 and, therefore, a rear end shape of the chamber expansion compartment 90 and a front end shape of the first muffler expansion compartment 92 can be formed to the same shape. Speaking differently, the sectional shape of the chamber expansion compartment 90 along a front surface of the partition wall 98 and the sectional shape of the first muffler expansion compartment 92 along a rear surface of the partition wall 98 are formed to the same shape.

As shown in FIG. 2, the exhaust chamber 82 is positioned substantially or generally intermediate between the combustion engine E and the rear wheel 22. An inner side surface 82*a* of the exhaust chamber 82 is positioned laterally inwardly of an outer side surface 22*a* of the rear wheel 22 in a motorcycle body widthwise direction and a rear portion of the muffler 84 is positioned laterally outwardly of the rear wheel 22 in the motorcycle body widthwise direction. A motorcycle body inner end 98*a* of the front wall (partition wall) 98 of the muffler 84 and a motorcycle body inner end of a muffler front portion in the vicinity of the front wall 98 are positioned laterally inwardly of the outer side surface 22*a* of the rear wheel 22 in the motorcycle body widthwise direction.

On the other hand, a motorcycle body outer end 98*b* of the front wall 98 and a motorcycle body outer end of the muffler front portion in the vicinity of the front wall 98 are positioned laterally outwardly of the outer side surface 22*a* of the rear wheel 22 in the motorcycle body widthwise direction. Since the collecting tube 32 including the catalytic unit 42, the exhaust chamber 82 and the muffler 84 are thus disposed on a right side of the motorcycle body with respect to the longitudinal mid-center plane C, a range from the collecting tube 32 to the exhaust chamber 82 can be formed as a simple path with minimized number of curves, and also a region below the combustion engine E will not be compressed. Accordingly, with the combustion engine E positioned low, an oil pan 85 and the rear suspension unit 74 can be disposed in a side by side relation with the exhaust system 40 in a direction widthwise of the motorcycle body.

As shown in FIG. 5, the exhaust chamber 82 referred to above has the chamber expansion compartment 90 defined therein and the muffler 84 has first to third muffler expansion compartments 92, 94 and 96 defined therein. More specifically, the interior of the casing 69, which forms the contour of the exhaust to silencing device 34, is divided by the first partition wall 98, which is the front wall 98, a second partition wall 100 and a third partition wall 102 in the order from front, into four inner spaces, i.e., the chamber expansion compartment 90 and the first to third muffler expansion compartments 92, 94 and 96, respectively.

The chamber expansion compartment 90, which is the most foremost inner space, is formed intermediate between the connecting tube 36 and the first partition wall 98. A pipe 104 communicated with the connecting tube 36 extends through the chamber expansion compartment 90 while upwardly curved within the chamber expansion compartment 90. The pipe 104 has a downstream end fluid connected with a first communicating tube 105 by means of welding. The first communicating tube 105 is, after having extended through the first partition wall 98, communicated with the first muffler expansion compartment 92 of the muffler 84 neighboring rearwardly thereof. This pipe 104 is formed with a plurality of communicating holes 106. A portion of the exhaust gases flowing inside the pipe 104 flows into the chamber expansion compartment 90 through the communicating holes 106 and is then expanded and silenced. The pipe 104 and the first communicating tube 105 are connected together within the chamber expansion compartment 90 and the first communicating tube 105 is welded to the first partition wall 98.

The first muffler expansion compartment 92 of the muffler 84 is formed intermediate between the first and second partition walls 98 and 100. In other words, the second partition wall 100 forms a rear wail 100 of the first muffler expansion compartment 92 which is the most upstream expansion compartment of the muffler 84. As shown in FIG. 2, the rear wall 100 has an inner end 100*a* positioned outwardly of the rear wheel 22. As shown in FIG. 5, within the first muffler expansion compartment 92, the exhaust gases flowing from the first communicating tube 105 are expanded, resonated and silenced. The second partition wall 100 is provided with a second communicating tube 108 and a third communicating tube 110. The second communicating tube 108 communicates the first muffler expansion compartment 92 with the second muffler expansion compartment 94 which is the rearmost inner space. The third communicating tube 110 communicates the first muffler expansion compartment 92 with the third muffler expansion compartment 96 which is an inner space neighboring rearwardly thereof.

The second muffler expansion compartment 94 is formed intermediate between the third partition wall 102 and the rear end wall 73 fitted to the casing 69. In the second muffler expansion compartment 94, the exhaust gases flowing from the second communicating tube 108 are expanded and silenced. This third partition wall 102 is provided with a fourth communicating tube 112 for fluid connecting the second muffler expansion compartment 94 and the third muffler expansion compartment 96 together.

The third muffler expansion compartment 96 referred to above is formed intermediate between the second and third partition walls 100 and 102. In this third expansion compartment 108, the exhaust gases flowing from the third communicating tube 110 and the fourth communicating tube 112 are expanded and silenced. The third and fourth communicating tubes 110 and 112 referred to above are disposed so as to face in a direction of flow of the exhaust gases. The exhaust gases, flowing from the first muffler expansion compartment 92 through the third communicating tube 110, and the exhaust gases, flowing from the third muffler expansion chamber 96 through the fourth communicating tube 112 collide against each other within the third muffler expansion compartment 96. Accordingly, expansion and silencing of the exhaust gases are further accelerated.

The third partition wall 102 is provided with two, fifth and sixth communicating tubes 114 and 116 for communicating the third muffler expansion compartment 96 with the outside of the casing 69. The exhaust gases which have been expanded and silenced within the third muffler expansion compartment 96 are discharged to the outside through the exhaust ports 71 and 71 by way of the fifth and sixth communicating tubes 114 and 116.

Figure 7:
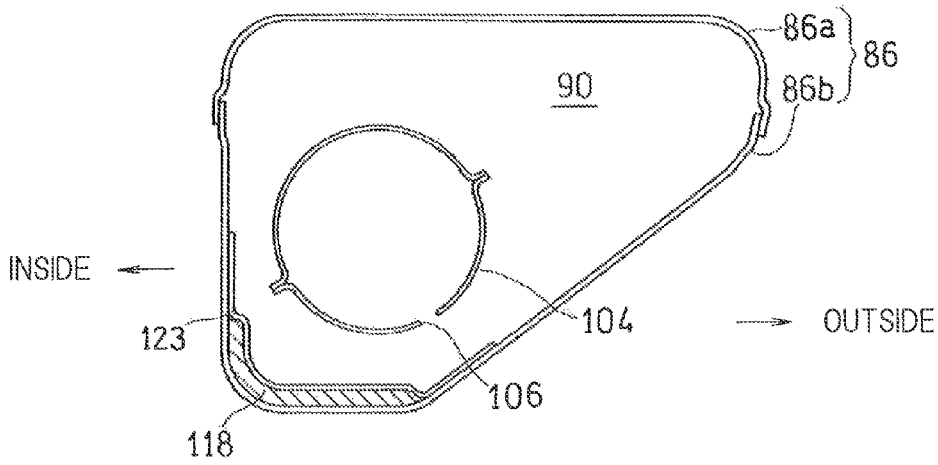
FIG. 7 is a cross sectional view taken along the line VII-VII shown in FIG. 5.

First to third heat insulating materials 118, 120 and 122 such as, for example, wools are fitted to a lower surface of an inner wall of the chamber expansion compartment 90, an upper surface of an inner wall of the first muffler expansion compartment 92 of the muffler 84 and an outer side surface of the inner wall of the first muffler expansion compartment 92 of the muffler 84, respectively. As best shown in FIG. 7, the exhaust chamber 84 is formed to represent a substantially or generally trapezoidal shape with its long sides lying upwardly thereof. Accordingly, it is possible to gain the bank angle of the motorcycle body. A retainer plate 123 made of a steel material is welded to an inner surface of the first casing region 86 forming the chamber expansion compartment 90. The first heat insulating material 118 referred to previously is interposed between the retainer plate 123 and the inner surface of the first casing region 86.

Figure 6:
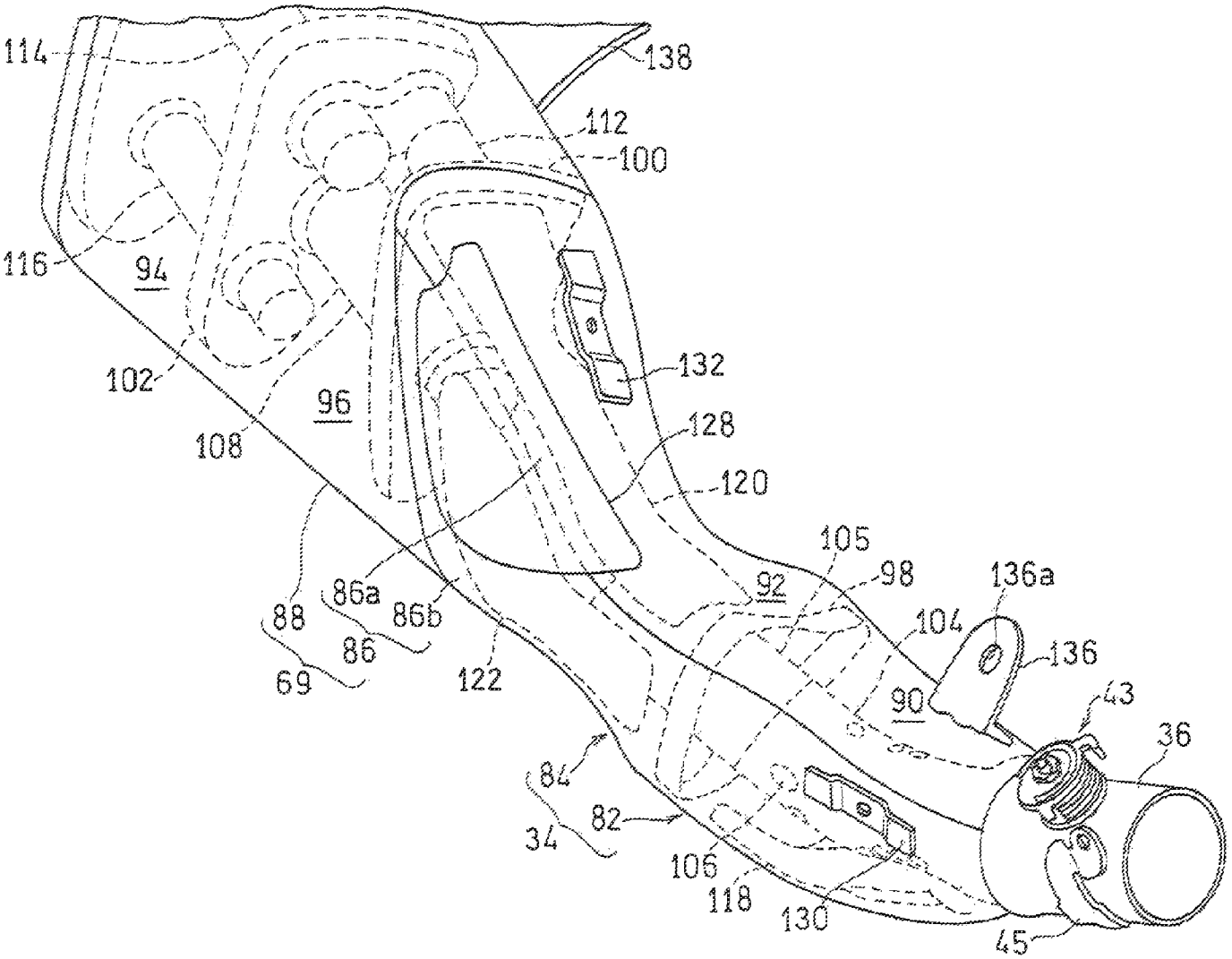
FIG. 6 is a perspective view showing the exhaust silencing device shown in FIG. 5.
Figure 8:
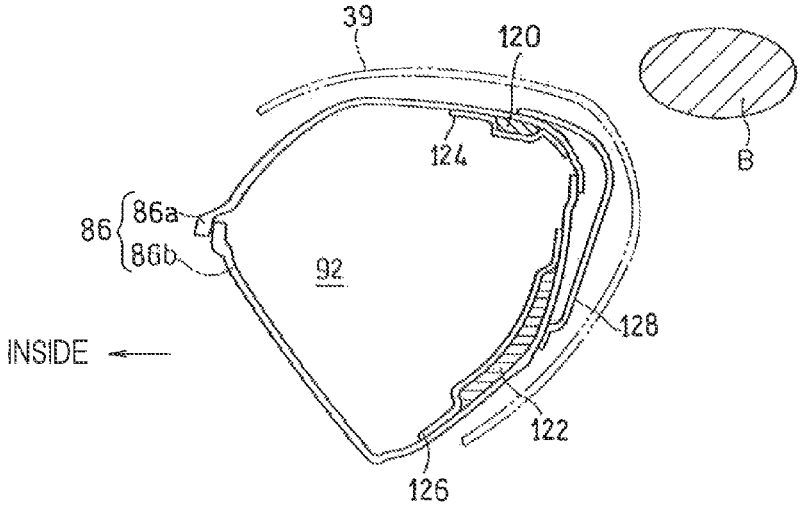
FIG. 8 is a cross sectional view taken along the line VIII-VIII shown in FIG. 5.

As shown in FIG. 8, retainer plates 124 and 126, each made of a steel material, are welded to the inner surface of the first casing region 86 forming the first muffler expansion compartment 92, respectively. The second heat insulating material 120 is interposed between the retainer plate 124 and the inner surface of the first casing region 86 while the third heat insulating material 122 is interposed between the retainer plate 126 and the inner surface of the first casing region 86. As best shown in FIG. 6, a heat insulating plate 128 made of a steel material is fixedly welded to the outer peripheral wall (first casing region 86) of the first muffler expansion compartment 92 so as to enclose an outer side portion of the outer peripheral wall of the first muffler expansion compartment 92 from above. It is, however, to be noted that the heat insulating plate 128 may be employed in two or more in number in a laminated fashion.

Second and third covering fitting brackets 130 and 132, each made of a steel material, are fixedly welded to a front side portion of and a rear upper portion of the first casing region 86, respectively. The covering 39 (best shown in FIG. 1) is fitted to the exhaust system 40 at three locations, including a portion of the first covering fitting bracket 45, the second covering fitting bracket 130 and the third covering fitting bracket 132, with the use of connecting members all not shown.

As described above, the second and third heat insulating materials 120 and 122 are fitted to the inner surface of the first casing region 86 forming the first muffler expansion compartment 92, and the heat insulating plate 128 is provided in the outer surface of the first casing region 86 and the first casing region 86 is enclosed from the outside by the covering 39. Accordingly, even though the brake pedal 68 or the rider's footrest 70, both shown in FIG. 1, is placed, it is possible to avoid a transmission of heat, generated inside the first muffler expansion compartment 92 shown in FIG. 8, to a region B where a rider's foot approaches.

As hereinabove described, the first casing region 86 forming the contour of the first muffler expansion compartment 92 of the exhaust chamber 82 and the muffler 84 both shown in FIG. 5 represent a shape so complicated as to enable the bank angle to be gained, to enable it to have a large capacity and to enable a countermeasure to be taken against heat. In order to realize such a complicated shape, the first casing region 86 is of a split structure including two divided casing components that are positioned one above the other. As shown in FIG. 1, since the exhaust chamber 82 and a front portion of the muffler 84 are covered by the covering 39, the appearance will not be deteriorated even though the shape is made complicated in order to increase the exhaust efficiency. As a result, regardless of the appearance, the exhaust chamber 82 and the front portion of the muffler 84 can be formed and, even though the shape is complicated, the yield can be increased.

A major portion of the second casing region 88 defining the contour of the second and third muffler expansion chambers 94 and 96 of the muffler 84 is not covered by the covering 39. Accordingly, as best shown in FIG. 5, the second casing region 88 represents a tubular, oval simplified structure so chosen as to maintain the appearance of the motorcycle. This second casing region 88 has an inner surface provided with a heat insulating material 134 such as, for example, wool disposed therein by means of any known means.

A first fitting piece 136 is fixed to a portion of an outer peripheral surface of the first casing region 86 adjacent a front end portion thereof by means of welding. This first fitting piece 1.36 is formed with a bolt insertion hole **136*a*. Also, a second fitting piece 138 is fixed to a portion of an outer peripheral surface of the second casing region 88 adjacent a rear end portion thereof by means of welding. Even this second fitting piece 138 is formed with a bolt insertion hole 138*a*** in the form of a slot.

Each of upstream end portions of the exhaust tubes 30 is inserted in a corresponding fitting hole (not shown), which is defined in the cylinder head 28, to allow a front portion of the exhaust system 40 to be supported by the motorcycle body through the cylinder head 28 (combustion engine E). While in this condition, a bolt (not shown) is inserted from the outside of the motorcycle body into the bolt insertion hole **136*a* in the first fitting piece 136 provided in the first casing 86 and is in turn fastened into a threaded hole (also not shown) defined in the swingarm bracket 16. By so doing, a longitudinal intermediate portion of the exhaust system 40 is supported by the swingarm bracket 16 on the main frame 1**, that is, by the motorcycle body.

Also, a bolt 140 best shown in FIG. 1 is inserted from the outside of the motorcycle body into the bolt insertion hole **138*a* in the second fitting piece 138 provided in the second casing region 88. Thereafter, the bolt 140 is fastened into a threaded hole (not shown) defined in the bracket 72, fixed to the swingarm bracket 16, to thereby permit a rear portion of the exhaust system 40** to be supported by the motorcycle body.

With the exhaust system of the motorcycle so constructed as described hereinabove, as best shown in FIG. 2, the exhaust chamber 82 is positioned substantially or generally intermediate between the combustion engine E and the rear wheel 22 and the inner side surface 82*a* of the exhaust chamber 82 is positioned inwardly of the outer side surface 22*a* of the rear wheel 22 in the motorcycle body widthwise direction. Accordingly, without the space below the combustion engine E being compressed, the exhaust chamber 82 of an increased capacity can be disposed. As a result, a sufficient silencing effect can be maintained, and also the muffler 84 can be downsized to enhance the appearance of the motorcycle. Also, since the exhaust chamber 82 and the muffler 84 will not compress the space below the combustion engine E, the position of the combustion engine E can be lowered to lower the center of gravity of the motorcycle.

As best shown in FIG. 4, the outer peripheral wall of the exhaust chamber 82 and the outer peripheral wall of the first muffler expansion compartment 92 are commonly formed by the single casing 69 and a rear surface shape of the chamber expansion compartment 90 and a front surface shape of the first muffler expansion compartment 92 are formed identical with each other. Accordingly, the first muffler expansion compartment 92, which is positioned frontmost within the muffler 84 continued with the exhaust chamber 82 of the increased capacity, can be made large. As a result thereof, a further downsizing of the muffler 84 and a further increase of the silencing effect of such muffler 84 can be accomplished. Since as discussed above the muffler 84 can be downsized, it is possible to shorten the length of the muffler 84 as measured in a direction parallel to the longitudinal sense of the motorcycle. Because of the reasons discussed above, the position of the exhaust silencing device 34, including the muffler 84, in the anteroposterior direction can be brought close to the center of gravity of the motorcycle body, and also it is possible to suppress a possible of increase of the weight of a right side portion of the motorcycle body to a value greater than that of a left side portion of the same motorcycle body. Consequently, the straightforward travel characteristic and the steerability of the motorcycle can be increased.

As best shown in FIG. 2, the motorcycle body inner side end 98*a* of the front wall 98 of the muffler 84 is positioned laterally inwardly of the outer side surface 22*a* of the rear wheel 22 in the motorcycle body widthwise direction and the motorcycle body outer side end 98*b* of the front wail 98 of the muffler 84 is positioned laterally outwardly of the motorcycle body with respect to the outer side surface 22*a* of the rear wheel 22. Accordingly, the motorcycle widthwise dimension of the front portion of the muffler 84 becomes large and, hence, the first muffler expansion compartment 92 positioned foremost within the muffler 84 can be further increased.

Since as shown in FIG. 4, communicating holes 106 communicated with the chamber expansion compartment 90 are provided in a peripheral wall of the pipe 104 extending through the chamber expansion compartment 90, the silencing effect can be furthermore increased by enhancing an effect of silencing a particular frequency with the utilization of the resonance effect.

Since as shown in FIG. 2 the muffler 84 is disposed on a right side of the rear wheel 22 and the rear suspension unity 74 is disposed on a left side with respect to the longitudinal mid-center plane C of the motorcycle body while juxtaposed left and right relative to the exhaust chamber 82, it is easy to install the exhaust chamber 82 inwardly of the motorcycle body.

Since as shown in FIG. 4, the exhaust device 43 is disposed on an upstream side of the exhaust chamber 82, a reaction of the exhaust characteristic change relative to the valve operation will be good as compared with the disposition of the exhaust device 43 at a position immediately preceding the muffler 84.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the preferred embodiment reference has been made to a so-called naked type motorcycle in which the headlamp unit 46 is supported by the front fork assembly 10, the present invention can be equally applied to any type of motorcycles.

Accordingly, such changes and modifications are, unless they depart from the scope of the present invention as delivered from the claims annexed hereto, to be construed as included therein.

REFERENCE NUMERALS

22 . . . Rear wheel
43 . . . Exhaust device
69 . . . Casing
74 . . . Rear suspension (Rear wheel shock absorbing mechanism)
82 . . . Exhaust chamber
84 . . . Muffler
90 . . . Chamber expansion compartment
92 . . . First muffler expansion compartment
94 . . . Second muffler expansion compartment
96 . . . Third muffler expansion compartment
98 . . . Partition wall (Front wall of the muffler, First partition wall)
98*a* . . . Motorcycle body inner end of the front wall
98*b* . . . Motorcycle body outer end of the front wall
104 . . . Pipe
106 . . . Communicating hole
C . . . Longitudinal mid-center plane
E . . . Combustion engine

What is claimed is:

1. A motorcycle of a type using a combustion engine as a drive source, which motorcycle comprises:

an exhaust chamber having defined therein a chamber expansion compartment for exhaust gases and also having a first outer peripheral wall; and a muffler having defined therein a muffler expansion compartment for the exhaust gases and also having a second outer peripheral wall, the muffler being positioned downstream of the exhaust chamber with respect to the direction of flow of the exhaust gases, wherein the exhaust chamber is positioned between the combustion engine and a rear wheel;

the first and second outer peripheral walls of the exhaust chamber and the muffler are formed by a common casing;

a partition wall divides the casing in an anteroposterior direction to define the chamber expansion compartment, which is positioned forwardly of the partition wall, and the muffler expansion compartment which is positioned rearwardly of the partition wall, a rear end shape of the chamber expansion compartment and a front end shape of the muffler expansion compartment being identical with each other;

the exhaust chamber has an inner side surface that is positioned inwardly of an outer side surface of the rear wheel in a motorcycle body widthwise direction; and the muffler has a rear portion that is positioned on an outer side of the rear wheel;

a motorcycle body inner side end of a front wall of the muffler is positioned inwardly of the outer side surface of the rear wheel in the motorcycle body widthwise direction; and an inner side surface of the muffler includes an inclined surface gradually inclined outwardly from a front end thereof toward a rear end thereof.

2. The motorcycle as claimed in claim 1, wherein a motorcycle body outer side end of the front wall of the muffler is positioned outwardly of the outer side surface of the rear wheel in the motorcycle body widthwise direction.

3. The motorcycle as claimed in claim 1, further comprising a pipe extending through the chamber expansion compartment to form a part of an exhaust passage, wherein the pipe has a peripheral wall provided with communicating holes to communicate with the chamber expansion compartment.

4. The motorcycle as claimed in claim 1, wherein the muffler is disposed on one side of the rear wheel with respect to a motorcycle body widthwise direction; and a rear wheel shock absorbing mechanism is positioned on the opposite side of the motorcycle body widthwise direction with respect to a longitudinal mid-center line and also is juxtaposed to the exhaust chamber in the motorcycle body widthwise direction.

5. The motorcycle as claimed in claim 1, further comprising an exhaust device to regulate an exhaust passage sectional area, the exhaust device being disposed upstream of the exhaust chamber.

6. The motorcycle as claimed in claim 1, wherein the muffler expansion compartment includes a front half part and a rear half part, the rear half part has a longitudinal axis extending in a direction substantially conforming to a longitudinal direction of the motorcycle in a plane view, and the front half part has a longitudinal axis gradually inclined outwardly from a front end thereof toward a rear end thereof.

7. The motorcycle as claimed in claim 6, wherein the muffler has a partition member configured to partition the front half part and the rear half part, and the muffler expansion compartment includes a first expansion compartment defined between the partition wall and the partition member.

8. The motorcycle as claimed in claim 6, wherein the front half part of the muffler expansion compartment has a vertical dimension gradually increasing toward the rear.

9. The motorcycle as claimed in claim 1, wherein the exhaust chamber has a cross-sectional dimension gradually increasing along a flow direction of the exhaust gases toward a downstream side.

10. The motorcycle as claimed in claim 3, wherein the pipe extends through the chamber expansion compartment and reaches the muffler expansion compartment.

11. A motorcycle of a type using a combustion engine as a drive source, which motorcycle comprises:

an exhaust chamber having defined therein a chamber expansion compartment for exhaust gases and also having a first outer peripheral wall; and a muffler having defined therein a muffler expansion compartment for the exhaust gases and also having a second outer peripheral wall, the muffler being positioned downstream of the exhaust chamber with respect to the direction of flow of the exhaust gases, wherein the exhaust chamber is positioned rearward and to one side of the combustion engine and located forward of a rear wheel and offset from a longitudinal center plane of the motorcycle;

the first and second outer peripheral walls of the exhaust chamber and the muffler are formed by a single common outer sidewall casing;

a partition wall divides the single common casing in an anteroposterior direction to define locations of the chamber expansion compartment, which is positioned forwardly of the partition wall, and the muffler expansion compartment which is positioned rearwardly of the partition wall, a rear end shape of the chamber expansion compartment and a front end shape of the muffler expansion compartment being identical in configuration with each other;

the exhaust chamber has an inner side surface that is positioned inwardly of an outer side surface of the rear wheel in a motorcycle body widthwise direction; and the muffler has a rear portion that extends at an angle upward from the exhaust chamber and is positioned on an outer side of the rear wheel, wherein the longitudinal alignment of axes of the exhaust chamber and the muffler are offset from each other.

12. The motorcycle as claimed in claim 11 wherein the single common casing of the exhaust chamber has a generally cross sectional trapezoidal shape that transitions to a generally tubular oval cross sectional shape in the muffler with a banking angle extending upward to complement a side covering of the motorcycle.

13. The motorcycle as claimed in claim 11 wherein a single pipe receives exhaust gas from an exhaust device that is operative to adjust a cross sectional area of the exhaust gas located upstream from the exhaust chamber, the single pipe extends through the exhaust chamber and the partition wall to discharge the exhaust gas into the muffler, the single pipe has a plurality of communicating holes that reside in the exhaust chamber to permit expansion and silencing of the exhaust gas before release in the muffler.

14. The motorcycle as claimed in claim 11, wherein a motorcycle body inner side end of a front wall of the muffler is positioned inwardly of the outer side surface of the rear wheel in the motorcycle body widthwise direction, and a motorcycle body outer side end of the front wall of the muffler is positioned outwardly of the outer side surface of the rear wheel in the motorcycle body widthwise direction.

15. The motorcycle as claimed in claim 11, wherein the muffler is disposed on one side of the rear wheel with respect to a motorcycle body widthwise direction; and a rear wheel shock absorbing mechanism is positioned on the opposite side of the motorcycle body widthwise direction with respect to a longitudinal mid-center line and also is juxtaposed to the exhaust chamber in the motorcycle body widthwise direction.

16. The motorcycle as claimed in claim 11, further comprising an exhaust device to regulate an exhaust passage sectional area, the exhaust device being disposed upstream of the exhaust chamber.

* * * * *